US011414718B2

(12) United States Patent
Ghanimi et al.

(10) Patent No.: US 11,414,718 B2
(45) Date of Patent: Aug. 16, 2022

(54) METHOD FOR THE SURFACE TREATMENT OF A STEEL YANKEE

(71) Applicant: Andritz AG, Graz (AT)

(72) Inventors: Yassar Ghanimi, Hausmannstätten (AT); Michael Jesse, Graz (AT)

(73) Assignee: ANDRITZ AG, Graz (AT)

( * ) Notice: Subject to any disclaimer, the term of this patent is extended or adjusted under 35 U.S.C. 154(b) by 156 days.

(21) Appl. No.: 16/616,661

(22) PCT Filed: Mar. 22, 2018

(86) PCT No.: PCT/EP2018/057261
§ 371 (c)(1),
(2) Date: Nov. 25, 2019

(87) PCT Pub. No.: WO2018/219516
PCT Pub. Date: Dec. 6, 2018

(65) Prior Publication Data

US 2020/0199697 A1 Jun. 25, 2020

(30) Foreign Application Priority Data

Jun. 1, 2017 (AT) ..... A 50458/2017

(51) Int. Cl.
*C21D 1/09* (2006.01)
*C21D 10/00* (2006.01)
*D21F 5/02* (2006.01)

(52) U.S. Cl.
CPC ..... *C21D 1/09* (2013.01); *C21D 10/005* (2013.01); *D21F 5/021* (2013.01); *C21D 2211/005* (2013.01); *C21D 2211/009* (2013.01)

(58) Field of Classification Search
None
See application file for complete search history.

(56) References Cited

U.S. PATENT DOCUMENTS 4,196,689 A 4/1980 Wolf et al.

FOREIGN PATENT DOCUMENTS

| | | | | | |
|---|---|---|---|---|---|
| CN | 102605296 | A | * | 7/2012 | ..... C22C 38/60 |
| DE | 102007000508 | A1 | | 4/2009 | |
| DE | 102012104464 | A1 | | 11/2013 | |
| EP | 0505343 | A1 | * | 9/1992 | ..... C21D 9/38 |
| EP | 0601451 | A1 | * | 6/1994 | ..... C21D 5/00 |
| EP | 2628808 | A1 | | 8/2013 | |
| EP | 2474665 | B1 | | 3/2015 | |
| JP | 2003231914 | A | | 8/2003 | |
| WO | 2008105005 | A1 | | 9/2008 | |

OTHER PUBLICATIONS

Espacenet machine translation of EP 0601451 A1 (Year: 2021).*
Espacenet machine translation of CN 102605296 (Year: 2022).*

(Continued)

*Primary Examiner* — Alexandra M Moore
*Assistant Examiner* — Christopher D. Moody
(74) *Attorney, Agent, or Firm* — Alix, Yale & Ristas, LLP

(57) ABSTRACT

A method for treating a Yankee cylinder, where the Yankee cylinder has a cylinder shell made of steel with a ferritic-pearlitic structure. In the disclosed method, the outer surface of the cylinder shell is heat-treated with a laser beam and hardened as a result.

18 Claims, 1 Drawing Sheet

(56) References Cited

OTHER PUBLICATIONS

International Search Report dated Jun. 14, 2018 (PCT/EP2018/057261).
International Preliminary Report on Patentability dated May 2, 2019 (PCT/EP2018/057261).
International Preliminary Report on Patentability dated May 2, 2019 for International Patent Application No. PCT/EP2018/057261.

* cited by examiner

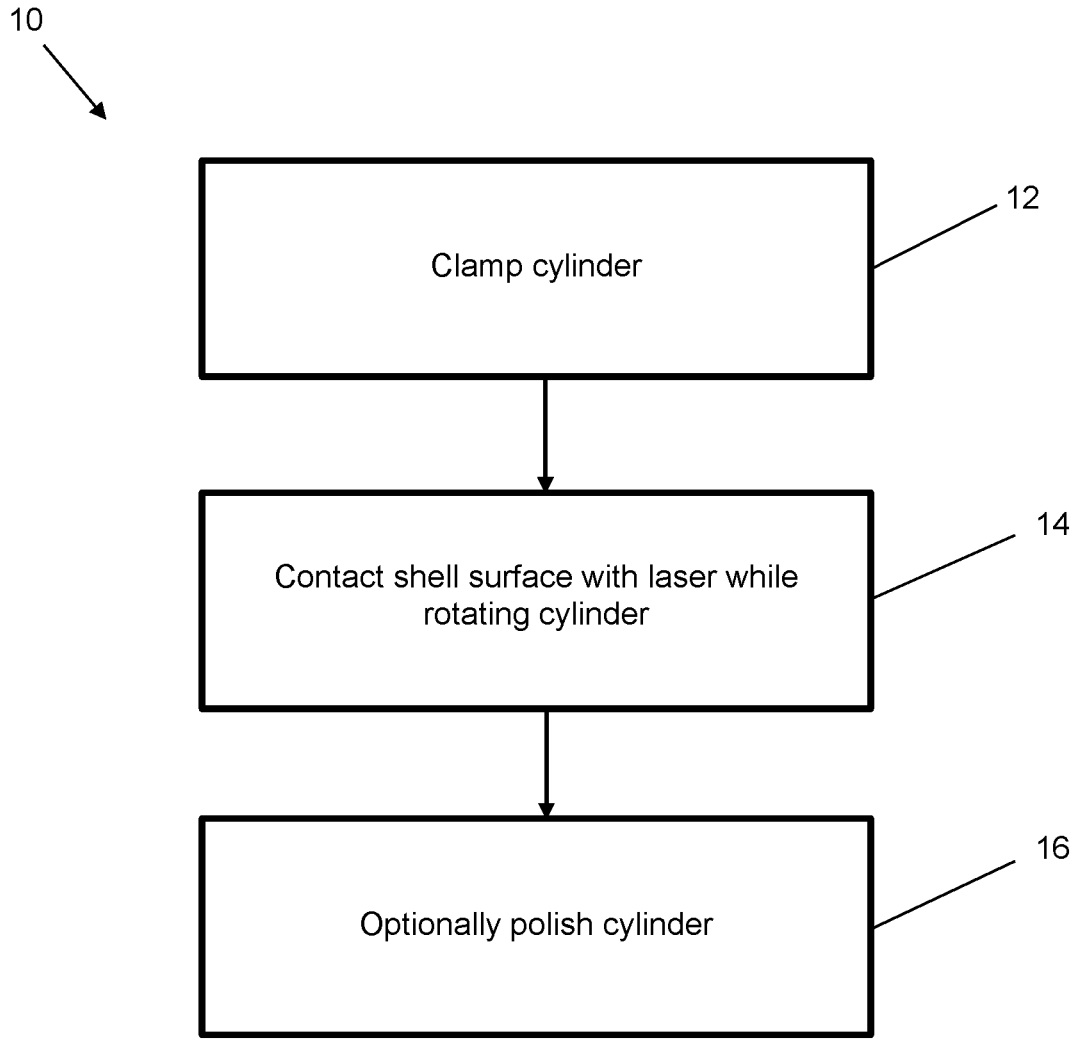
10
Clamp cylinder
12
Contact shell surface with laser while rotating cylinder
14
Optionally polish cylinder
16

METHOD FOR THE SURFACE TREATMENT OF A STEEL YANKEE

BACKGROUND

Disclosed herein is a method for treating a Yankee cylinder, where the Yankee cylinder has a cylinder shell made of steel with a ferritic-pearlitic structure.

In the production of paper webs or tissue, so-called Yankee cylinders are commonly used in the drying process.

Yankee cylinders usually have a very large diameter. They are heated with steam from the inside and difficult to manufacture because there are very strict requirements to be fulfilled relating to internal pressures, impermeability and the large diameters.

Standard Yankee cylinders, for example, have the following dimensions:

Cylinder diameter: 2000 mm to 6500 mm

Hollow shaft diameter: 1000 mm to 2500 mm

Cylinder length: 3000 mm to 8500

Cylinder mass: 35 tons to 180 tons

In the drying process for a pulp web, a doctor blade rests on the outer circumferential surface of the Yankee cylinder and scrapes the dried pulp web off the surface of the Yankee. It is not inconceivable that material is removed from the cylinder surface due to the doctor blade possibly coming into contact with the surface of the Yankee. In order to reduce this material erosion, the surface of the Yankee is usually coated with a layer of hard material. EP 2 474 665 A1, for example, describes a Yankee cylinder that is coated with an appropriate hard material layer.

In the past, Yankee cylinders were made predominantly of cast iron, however Yankee cylinders made of steel are also know from the U.S. Pat. No. 4,196,689 and from WO 2008/105005 A1.

Yankee cylinders made of steel show better drying performance than cast cylinders because steel has better heat conductivity.

However, since steel (140 Brinell hardness) is not as hard as cast material (240 Brinell hardness), steel Yankees are thermally coated with a layer of wear protection. In this process, a wire is melted and sprayed onto the surface of the Yankee; the thermally sprayed coating produced is much harder than steel.

The layers sprayed on are approximately 0.75 mm thick.

However, this type of surface treatment involves considerable effort because the cylindrical surface has to be sandblasted before coating and then ground and polished after thermal coating. There is also a risk of the coating flaking off.

However, the main disadvantage of this coating that is sprayed on in a thermal process is its relatively low heat conductivity. The heat conductivity of a layer sprayed on thermally is only in a range of 3-7 W/mK. In comparison, the steel shell of a Yankee has thermal conductivity of up to 45 W/mK.

DE 10 2012 104 464 A1 describes a Yankee cylinder in which the surface finished is performed by means of laser treatment.

SUMMARY

A method for surface treatment of a steel Yankee cylinder that produces the hardest possible surface layer with high thermal conductivity is disclosed.

The method includes a step of heat-treating the outer surface of the cylinder shell with a laser beam, thereby hardening the outer surface.

BRIEF DESCRIPTION OF THE DRAWINGS

The invention will be described with reference to the drawing, in which:

FIG. 1 is a flow chart showing exemplary steps of the disclosed method.

DETAILED DESCRIPTION

In this process, a laser beam moves over the entire outer surface of the Yankee cylinder shell, which is thus heated and hardened.

The surface of the Yankee cylinder is heated briefly by the laser beam to a temperature between 800° C. and 900° C., where subsequent cooling of the austenitic layer remains below the lower critical cooling speed, with the result that formation of martensite is prevented.

A steel Yankee hardened according to the disclosed embodiments thus has 7% more heat transfer and enables a 5% increase in production compared to conventionally coated Yankee cylinders made of steel.

The hardened surface layer is between 0.3 and 1.5 mm thick.

Conventional laser beam hardening is conversion hardening in which ferritic-pearlitic steel is heated very quickly (at approximately 1,000 K/s) to a temperature at which the lattice structure is converted into a fine austenite. The cementite lamellae in the pearlite dissolve, and the carbon released diffuses into the inside of the austenite grain. When the laser beam moves away, the material cools down again quickly as a result of self-quenching and the lattice structure is transformed once again. In a conventional process for laser-hardening, the extremely fast cooling process suppresses diffusion of the carbon, which is dissolved evenly in the austenite. This prevents formation of the ferritic-pearlitic microstructure, and hard martensite is formed instead. Martensite is indeed very hard, however formation of martensite on the Yankee surface would be a disadvantage. Martensite favors the formation of micro-cracks, which can shorten the lifetime of the steel cylinder substantially.

In the disclosed method, there is no change in the structure, but only grain refinement, resulting in fine grain hardening. The ferritic-pearlitic structure remains intact, and the formation of martensite is prevented. Cooling of the austenitic layer must remain below the lower critical cooling speed here. Martensite still starts forming at the lower critical cooling speed.

It is favorable if steels according to ASME SA516, ASME SA36 and AD2000 W1, 2.1 to 2.4, are used as basic material for the cylinder shell. For example, P355NH (DIN EN 10028-3) is suitable as basic material.

This fine-grained structural steel features a minimum yield stress of 275-460 MPa as well as good weldability and resistance to brittle fracture. As a result of laser-beam hardening, up to 400 Brinell hardness can be obtained if conventional methods are used for hardening. This new method seeks to achieve a maximum of 320 Brinell hardness, with excellent thermal conductivity in the region of 45 W/mK.

In comparison, cast cylinders have between 230 and 280 Brinell hardness.

A high-power diode laser or $CO_2$ laser is preferably used for heat treatment so that heating rates of >1000° C./s are achieved.

The laser beam can also be used to create a pattern on the cylinder surface that can facilitate the formation of a chemical coating film. Various additional tasks can be performed with the chemical coating (adherence of the pulp web to the cylindrical surface, detachment of the pulp web at the end of the drying process, influencing the properties of the tissue produced). For example, a large number of indentations distributed evenly over the surface of the shell can be burned into the surface in order to make it porous.

The surface of the Yankee cylinder is preferably polished after heat treatment. Normally, it is no longer necessary to grind the surface.

In order to shorten the duration of the treatment, it is also possible to treat the outer surface of the cylinder shell simultaneously with several laser beams.

With reference to FIG. 1, the disclosed method (10) is described in the following using examples.

The largely finish-machined Yankee cylinder is preferably clamped horizontally allowing the axle stubs to rotate (12). One or several laser beams heat-treat the shell surface (14). The Yankee is rotated slowly during this process so that the laser beam scans the entire circumference area (14). The entire cylinder shell surface can be heat-treated by moving the laser in axial direction (parallel to the axis of the Yankee).

If several lasers are used, the process time can be shortened. The treatment process can be performed with a high-power diode laser that generates a powerful, high-energy laser beam.

This provides partial warming of the component very quickly (>1000° C./s). It is followed by self-quenching due to heat dissipation to the inside of the component and to the surrounding area. As a result, a hardened track is formed with a fine-grain micro-structure.

Hence, there is no need to anneal the Yankee.

The Yankee is then polished after heat treatment, however it is also conceivable that the polishing process can be omitted (16).

In addition, it is conceivable that the Yankee is heat-treated directly at its place of installation without being dismounted. In this way, Yankee cylinders already in use can be hardened subsequently.

The invention claimed is:

1. A method for treating a Yankee cylinder having a cylinder shell made of steel having an outer surface and a ferritic-pearlitic structure, comprising:

heat-treating the outer surface of the cylinder shell with one or more laser beams, thereby hardening the outer surface, wherein the one or more laser beams heat the outer surface to a temperature between 800° C. and 900° C. and an austenitic layer cools below a lower critical cooling speed so that formation of martensite on the outer surface is prevented and the ferritic-pearlitic structure is substantially retained.

2. The method for treating a Yankee cylinder according to claim 1, wherein the steel cylinder shell is made from P355NH grade steel.

3. The method for treating a Yankee cylinder according to claim 2, wherein the one or more laser beams used for heat treatment are generated by a diode or $CO_2$ laser.

4. The method for treating a Yankee cylinder according to claim 3, wherein the one or more laser beams burn a plurality of indentations into the outer surface.

5. The method for treating a Yankee cylinder according to claim 1, wherein the one or more laser beams used for heat treatment is generated by a diode or $CO_2$ laser.

6. The method for treating a Yankee cylinder according to claim 5, wherein the one or more laser beams burn a plurality of indentations into the outer surface.

7. The method for treating a Yankee cylinder according to claim 1, comprising a step of polishing the outer surface of the Yankee cylinder after heat treatment.

8. The method for treating a Yankee cylinder according to claim 2, comprising a step of polishing the outer surface of the Yankee cylinder after heat treatment.

9. The method for treating a Yankee cylinder according to claim 5, comprising a step of polishing the outer surface of the Yankee cylinder after heat treatment.

10. The method for treating a Yankee cylinder according to claim 6, comprising a step of polishing the outer surface of the Yankee cylinder after heat treatment.

11. The method for treating a Yankee cylinder according to claim 1, wherein the step of heat treating the outer surface of the cylinder shell is performed by a plurality of laser beams simultaneously.

12. The method for treating a Yankee cylinder according to claim 2, wherein the step of heat treating the outer surface of the cylinder shell is performed by a plurality of laser beams simultaneously.

13. The method for treating a Yankee cylinder according to claim 5, wherein the step of heat treating the outer surface of the cylinder shell is performed by a plurality of laser beams simultaneously.

14. The method for treating a Yankee cylinder according to claim 6, wherein the step of heat treating the outer surface of the cylinder shell is performed by a plurality of laser beams simultaneously.

15. The method for treating a Yankee cylinder according to claim 7, wherein the step of heat treating the outer surface of the cylinder shell is performed by a plurality of laser beams simultaneously.

16. The method of claim 1, wherein the one or more laser beams burn a plurality of indentations into the outer surface.

17. A method for treating a Yankee cylinder having a cylinder shell made of steel having an outer surface and a ferritic-pearlitic structure, comprising:

contacting the outer surface of the cylinder shell with one or more laser beams; and allowing the cylinder shell to self-quench after contact with the one or more laser beams, thereby substantially retaining the ferritic-pearlitic structure of the outer surface while preventing formation of martensite on the outer surface, and forming martensite in an area of the cylinder shell below the outer surface, resulting in hardening of the outer surface, wherein the one or more laser beams heat the outer surface to a temperature between 800° C. and 900° C. and an austenitic layer cools below a lower critical cooling speed.

18. The method of claim 17, wherein the one or more laser beams burn a plurality of indentations into the outer surface.

* * * * *